United States Patent [19]

Lawler

[11] 4,388,815

[45] Jun. 21, 1983

[54] PICK-PROOF LOCK

[76] Inventor: Michael S. Lawler, 7853 Melotte St., San Diego, Calif. 92119

[21] Appl. No.: 185,234

[22] Filed: Sep. 8, 1980

[51] Int. Cl.[3] ..... E05B 21/00; E05B 35/04

[52] U.S. Cl. ..... 70/134; 70/350; 70/387

[58] Field of Search ..... 70/134, 351, 387, 409, 70/363, 352, 350

[56] References Cited

U.S. PATENT DOCUMENTS

| | | | |
|---|---|---|---|
| 1,366,161 | 1/1921 | Clark | 70/409 |
| 1,721,747 | 7/1929 | Radosevic | 70/387 |
| 2,302,414 | 11/1942 | Buchanan-Wollaston | 70/387 |
| 3,777,520 | 12/1973 | Crepinsek | 70/409 |

*Primary Examiner*—Robert L. Wolfe

*Attorney, Agent, or Firm*—Henri J. A. Charmasson

[57] ABSTRACT

A pick-proof lock is provided which is rendered difficult or impossible to pick not by virtue of any additional structure or apparatus but due to the intrinsic nature of the tumbler construction wherein all of the tumblers in the row of tumblers are contiguous with adjacent tumblers so that the tumblers may not be individually set by using a pick and the equivalent of a tension wrench because there is no stationary shear plane in the direction of movement of the bolt for the tumblers to be set on.

9 Claims, 17 Drawing Figures

PICK-PROOF LOCK

BACKGROUND

Since the invention of the Yale tumbler lock in the first half of the 19th century, tumbler locks have come to dominate the lock industry, especially in the production of relatively small, mass produced locks. Although there are also lever tumbler and disk or wafer tumbler locks, the pin tumbler lock is by and large the most popular. However, all tumbler locks are subject to picking, and one skilled in the art of lock picking does not require too much time to finish picking most mass produced locks.

SUMMARY

The present invention avoids the possibility of the lock being picked not by the incorporation of some keyhole blocking structure or a lock within a lock, but rather by modifying the tumbler structure itself to make it impossible to set the tumblers at the shear plane between the bar and the casing. The bar of the instant lock contains within it a row of tumblers which is longitudinally extended, and the tumblers bear on their neighbors rather than on part of the casing or the bar itself, so that there is no stress interface between stationary casing and moveable bar to establish a ledge for the tumblers to be set on.

By this very simple expedient a basic, elemental tumbler operated bar lock is provided which can be adapted for use in virtually any locking situation, several of which are disclosed in the following description.

To pick a pin tumbler cylindrical lock a tool known among locksmiths as a tension wrench is inserted into the keyhole to apply a slight rotational force on the barrel or cylinder of the lock. This tension is adequate to apply a slight pinching force on all the tumblers which straddle the shear plane of the lock and therefore prevent the cylinder from turning.

The tension wrench is very small and blocks only a small portion of one end of the keyhole and one of various types of picks are inserted through the unblocked portion of the keyhole and are used to move the tumblers radially outwardly until they snap over the shear surface, and because of the slight play in the metal involved each tumbler, as it is set in this fashion, will remain set due to the slight dislocation of the tumbler chute at the shear plane. Thus, by maintaining constant rotational force on the barrel with the tension wrench, each tumbler can be successively set and when the last tumbler is set, the cylinder can be rotated to open the lock.

Different devices, some of them probably effective but rather complicated, have been introduced as pick-proof locks. However, the lock of the instant invention is elegant in its simplicity, and, having been designed by a master lock pick, modifies the exact structure which makes possible the picking of conventional locks rather than adding additional structure to obstruct the keyway, etc.

DETAILED DESCRIPTION OF THE PREFERRED EMBODIMENT

Figure 1:
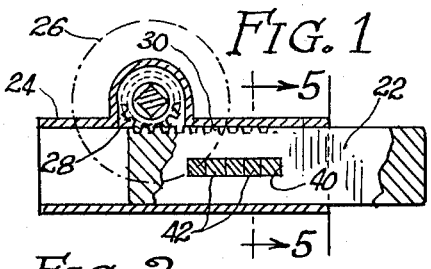
FIG. 1 is a section taken longitudinally through the bar of the lock used in a door.
Figure 2:
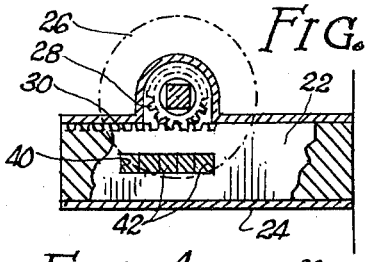
FIG. 2 is the lock of FIG. 1 after opening.

The embodiment of the lock illustrated in FIGS. 1 through 5 is a mortise lock of a deadbolt type having a bar 22 which is slidably housed in casing 24 and which, for the sake of illustration, is moved in and out by a door knob 26 having a pinion gear 28 on it which operates the rack 30. Any means of moving the bolt is acceptable and does not play a significant part in the invention.

The casing 24 is expanded at 32 and 34 to define interior cavities 36 and 38, respectively. These cavities would ordinarily be of cross sectional dimension equivalent to that of the tumbler slot 40 defined in the bar 22.

Sliding in this slot 40 are a plurality of tumblers 42, the term "tumbler" being used herein to define a set of two or more component tumblers 44.

Figure 3:
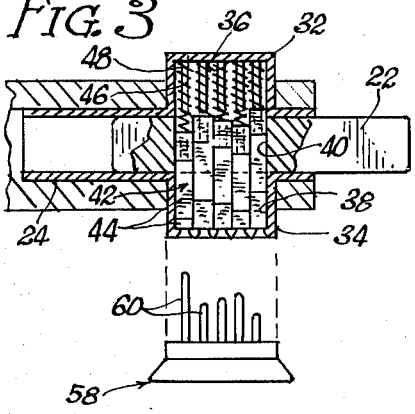
FIG. 3 is a horizontal section of the lock of FIG. 1 taken at the top surface of the tumblers.

As best seen in FIG. 3, a plurality of springs 46, engaged on guide rods 48 displace the tumblers, through drivers 50 such that the shear faces between the components 44, indicated at 52, are misaligned with the two shear planes 56.

In this orientation, because of the shoulders 56 defined by the cavities 36 and 38 along the shear plane, the misalignment of the shear faces of the component tumblers with the shear planes between bar and casing prevent movement of the bar.

Figure 4:
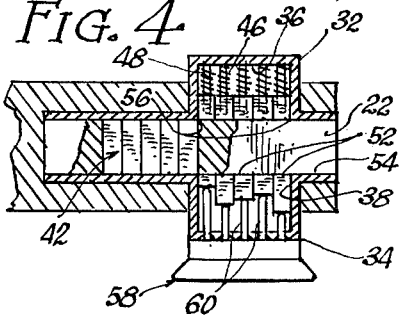
FIG. 4 is a section similar to FIG. 3 but with the key inserted.
Figure 5:
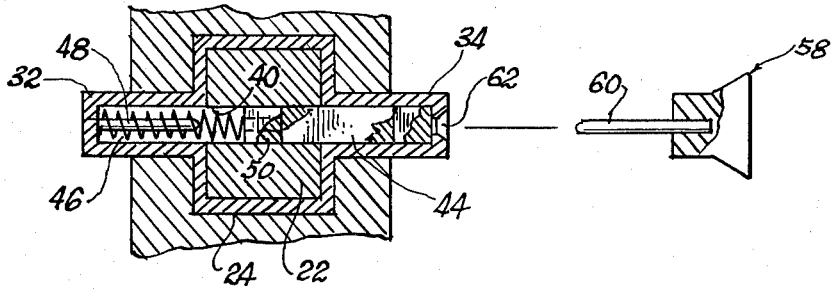
FIG. 5 is a section taken along Line 5—5 of FIGS. 1.

Alignment of the shear faces is achieved in the illustrated embodiment by the insertion of a key 58 having prongs 60 which pass through the holes 62 to achieve the results shown in FIG. 4, wherein the bar is free to move backwards or forwards. Note that drivers 50 may have to be bored to accommodate the rods 48 although other means of keeping the springs in position could be used.

It should be noted with particular reference to FIG. 3 that alignment of any one tumbler with the interface planes will not permit the bar to move even one tumbler width. This is because the cmponent tumbler outside of the bar still blocks the subsequent tumblers. Careful analysis will reveal that the bar will not move at all unless every one of the tumblers is in place. Also it will be noted that because the central tumblers have no shoulder to be set against because on both sides of each of them in the direction that the bolt-opening force would be applied there is only another tumbler, and no fixed structure of the bolt and casing across the shear plane to set the tumbler on. Therefore, it is impossible to pick the lock.

Also, although conceivably a conventional key or other opening device could be used in a slight modification of the lock, if the mortise of the door is properly shielded it is impossible to have access to the bolt to put a longitudinal force on it to even try to pick it. Essentially however, it is the contiguous row of tumblers, each one of which bears against the next rather than against a fixed portion of the lock, which invests the lock with its pick-proof quality. Other cross sectional shapes of the tumblers could be used such as triangular, hexagonal, or even circular, provided the tumblers are not individually isolated in their own tumbler chutes in the bar. It is also desirable that they have a broad contacting surface as in the case of the illustrated square cross sectioned tumblers so that the attempt to pick, or set any one tumbler would engage would engage and upset the setting of the adjacent tumbler.

Figure 6:
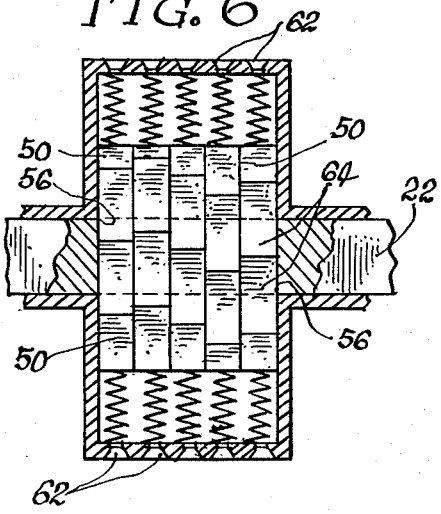
FIG. 6 is a section taken over the surface of the tumblers in a modified embodiment.
Figure 7:
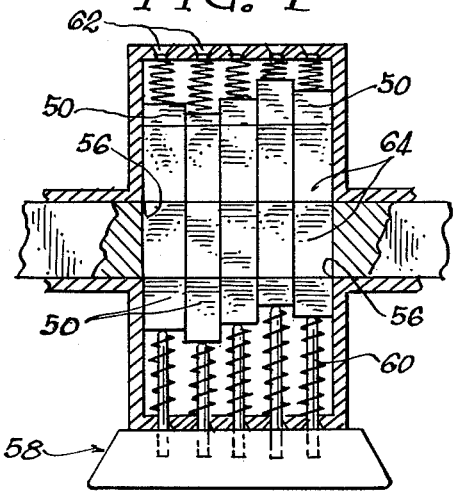
FIG. 7 is the modification of FIG. 6 with the key inserted.
Figure 8:
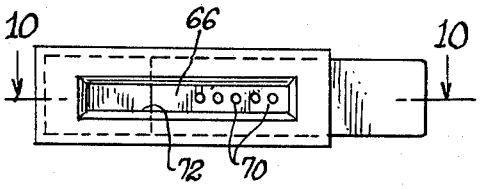
FIG. 8 is a side elevation view of a second modification of the lock.
Figure 9:
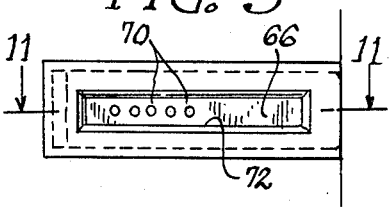
FIG. 9 is the lock of FIG. 8 with the bolt withdrawn.
Figure 10:
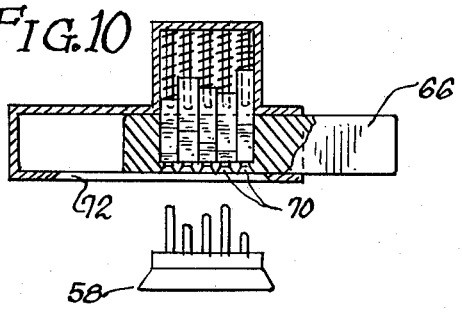
FIG. 10 is a section taken along Line 10—10 of FIG. 8.

FIGS. 6 and 7 illustrate a modification of the basic lock structure having keyholes 62 on both sides of the casing. This requires, in addition to the duplication of the springs 46, the utilization of a tumbler provided in identically sized components 64 and having dual drivers so that dislocation of the tumbler in either direction can be used to align the shear faces with the shear planes.

Figure 11:
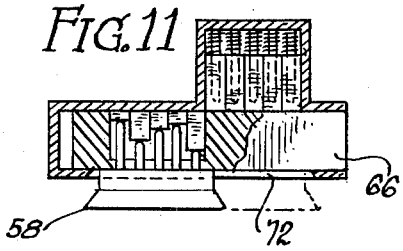
FIG. 11 is a section taken along Line 11—11 of FIG. 9.

Another modification is shown in FIGS. 8 through 11 wherein the key 58 is used as the bolt displacement knob as well as the unlocking device. In this embodiment a modified bar 66 has a tumbler slot which passes only partially through the bar, terminating in key prong hole 70. An elongated slot 72 in the side of the casing, which overlaps the prong holes 70, permits the key not only to be inserted to align the tumblers, but to move back and forth within the limits of the slot 72 as shown in FIG. 11, thus acting not only as the key but as the opening knob as well.

Figure 12:
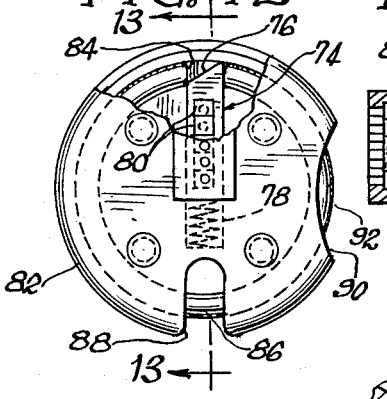
FIG. 12 is a top elevation view partially cut away of another embodiment, adapted as a padlock.
Figure 13:
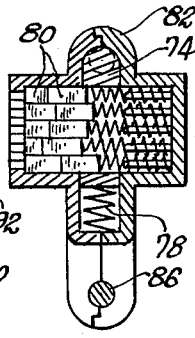
FIG. 13 is a section taken along Line 13—13 of FIG. 12.
Figure 14:
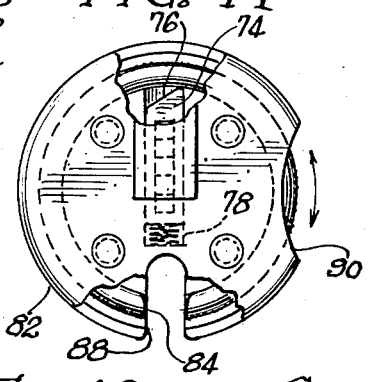
FIG. 14 is a view similar to FIG. 12 but with the lock opened.

A more radical departure from the above embodiments is shown in FIGS. 12 through 14 wherein a novel padlock is disclosed which utilizes the bar lock structure detailed above. In this embodiment, the bar itself is in the form of a latch 74 having a tapered foot 76 toward which end the latch bar is biased by spring 78. Tumblers 80 are accessed through holes in the disk-shaped outer casing 82, and when the tumblers are aligned the latch bar moves upwardly in FIG. 12 if, and only if, the gap 84 in the ring 86 is above the latch.

A slot 88 in the bottom of the latch is used to engage a chain or a hasp latch as an ordinary padlock, and the ring itself can be rotated by virtue of a cutaway section 90 by the thumb. The ring 86 has circumferential serrations to enable the ring to be easily rotated.

Operation of the padlock should be clear from the above description. In the position in FIG. 12 the ring is locked in place by the latch bar 74. When the key is inserted, the tumblers are properly aligned but the latch bar does not yet move because it is retained in place by the spring 78. However, proper rotation by the thumb to the cutaway 90 will exert a pressure on the foot 76, depressing the bar into the position of FIG. 14. Continued rotation of the ring frees the slot 88 and the lock is opened.

Figure 15:
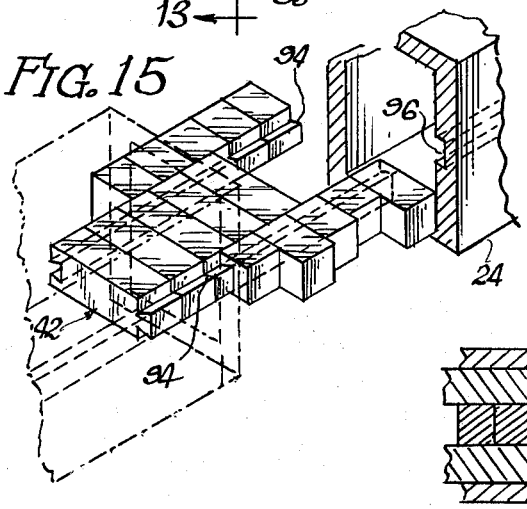
FIG. 15 is a perspective of a modification of the tumbler structure.
Figure 16:
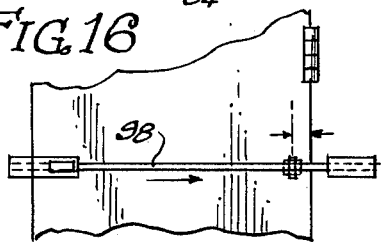
FIG. 16 is the implementation of the sliding bar lock in a double-bar door lock.
Figure 17:
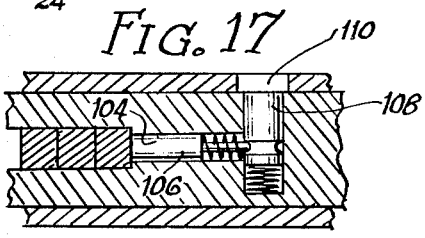
FIG. 17 is a detail of an adaptation of the lock which prevents a break-in from violent tumbler removal.

Three other slight modifications of the structure are shown in FIGS. 15 through 17. In FIG. 15, the interfaces between the component tumblers themselves and their drives are interlocked by means of dovetail structure 74. Depending on which way the dovetails are directed, a clearance slot must be provided at 96 in either the casing or the bolt, the disclosed embodiment showing this slot being in the casing.

The purpose of the variant tumbler structure of FIG. 15 is the prevention of separation of the component tumblers and the drivers which can be accomplished by a vibrator according to one picking technique. Vibration of the tumblers causes them to spread and establish rapidly oscillating gaps between each component part, which when brought to overlap the shear plane of the lock permits it to open.

In FIG. 16 the bar is incorporated in a door such that the original bar 22 is connected with a connector rod 98 through a hinge or pivot 100 to a secondary bar 102 which straddles the space between the hinged edge of the door and the door frame. The purpose of this structure is to enable both sides of the door to be barred when the door is locked, and when the lock bar is opened the door will still pivot because of the incorporation of the pivot 10, which will align, or substantially align, with the hinge axis of the door.

In FIG. 17 a modification which could be incorporated in any of the lock structures described above is shown comprising a passageway 104 which has a spring-loaded detent 106 which retains a spring-loaded dog 108 within the sliding bar. In the event a burgler attempts to simply drill out the tumblers, as soon as the absence of tumblers is experienced by the detent, it is released and the dog snaps into the opening 110 to permanently and irreversibly lock the bar within the casing.

As shown, described and claimed, the lock of the instant disclosure is not only pick-proof but elegantly simple in its provision of an elemental bar with a basic row of contiguous tumblers which can be adapted to any locking need including cylindrical locks, padlocks as shown, as well as the elemental deadbolt bar lock.

What is claimed is:

1. A pick-resistant bar lock comprising:

(a) a casing;

(b) a bar slideable in said casing in a longitudinal direction and defining at least one shear plane therewith;

(c) a longitudinally extended slot passing laterally through said bar;

(d) a plurality of side-by-side contiguous tumblers disposed in a longitudinal row occupying the volume of said slot;

(e) a clearance cavity defined in said casing adjacent said slot and defining at least one shoulder extending to said shear plane to block said bar when said tumblers are misaligned with said shear plane;

(f) access means defined in said casing providing access to said tumblers for keying manipulation thereof;

(g) a second shear plane and second cavity defined in said casing on the opposite side of said bar from first cavity and shear plane, and each of said cavities defining two shoulders aligned with the edges of said slot when same is aligned with said cavity;

(h) said access means comprises a hole generally axially aligned with each tumbler defined in the portion of said casing defining one of said cavities;

(i) the other of said cavities houses springs biasing said tumblers toward said holes and said tumblers are operated by prongs projecting through said holes; and (j) the portions of said casing defining said cavities are each provided with holes generally axially aligned with said tumblers and each of said cavities houses compression springs biasing said tumblers and each of said tumblers comprises at least two component tumblers to define two sets of shear surfaces to be aligned with said shear planes.

2. Structure according to claim 1 and including drivers disposed between each of said springs and their respective tumbler.

3. Structure according to claim 1 wherein said casing confines a circular gapped ring slideable in a circular track and defines a slot selectively alignable and misalignable with the gap in said ring, and said bar is disposed to engage in said gap when said ring is properly rotatively adjusted.

4. Structure according to claim 3 wherein said bar is spring-loaded to bear against said ring and has a tapered foot such that when said bar is engaged in said gap by said spring when properly aligned, and rotation of said ring against said tapered foot moves said bar when said tumblers align with said shear plane.

5. Structure according to claim 3 wherein said casing has a cutaway portion overlapping into said track to permit thumb rotation of said ring.

6. Structure according to claim 1 and including a dog mounted in said bar which is biased out of said bar into a hole in said casing which is aligned therewith when said bolt is locked, and further including a restraining detent biased against said dog to restrain same within said bar, and the biasing means for said detent being deactuated by the removal of said tumblers to irreversibly lock said bar in said casing if ever said tumblers are removed.

7. A pick-resistant bar lock comprising:

(a) a casing;

(b) a bar slideable in said casing in a longitudinal direction and defining at least one shear plane therewith;

(c) a longitudinally extended slot passing laterally completely through said bar;

(d) a plurality of side-by-side contiguous tumblers disposed in a longitudinal row occupying the volume of said slot;

(e) a clearance cavity defined in said casing adjacent said slot and defining at least one shoulder extending to said shear plane to block said bar when said tumblers are misaligned with said shear plane;

(f) access means defined in said casing on the side of said bar opposite said cavity providing access to said tumblers for keying manipulation thereof;

(g) spring means residing in said cavity biasing said tumblers toward said access means; and (h) a rigid key defining raised portions at a plurality of different levels when measured in a particular direction, said levels being such that when said key is inserted into said access means in said particular direction, said tumblers align at said shear plane.

8. Structure according to claim 2 wherein each of said drivers and its respective tumbler are mutually interengaged by sliding detent structure permitting the sliding of each component tumbler in one direction only, orthonormal to the longitudinal dimension of the tumblers to prevent separation of said tumblers and drivers from one another in their longitudinal dimension.

9. Structure according to claim 8 wherein said detent structure comprises an interlocked dovetail.

* * * * *